US012660913B2

(12) United States Patent
Stewart

(10) Patent No.: US 12,660,913 B2
(45) Date of Patent: Jun. 23, 2026

(54) FURNITURE TOP STRUCTURE

(71) Applicant: Scott Stewart, Milwaukie, OR (US)

(72) Inventor: Scott Stewart, Milwaukie, OR (US)

( * ) Notice: Subject to any disclaimer, the term of this patent is extended or adjusted under 35 U.S.C. 154(b) by 93 days.

(21) Appl. No.: 18/627,176

(22) Filed: Apr. 4, 2024

(65) Prior Publication Data

US 2025/0311844 A1 Oct. 9, 2025

(51) Int. Cl.
*A47B 13/00* (2006.01)
*A47B 13/08* (2006.01)
*A47B 87/00* (2006.01)

(52) U.S. Cl.
CPC ..... *A47B 13/088* (2013.01); *A47B 87/002* (2013.01); *A47B 2087/004* (2013.01)

(58) Field of Classification Search
CPC ..... A47B 13/088; A47B 87/002; A47B 2087/004; A47B 13/10; A47B 17/065; A47B 2200/0045
USPC ..... 108/64–66, 93, 94, 139
See application file for complete search history.

(56) References Cited

U.S. PATENT DOCUMENTS 2,157,283 A * 5/1939 Dyson ..... B65G 17/066 198/831
2,694,611 A * 11/1954 Lorber ..... A47B 96/025 211/175
3,955,850 A * 5/1976 Toso ..... A47C 13/005 297/118
5,425,313 A * 6/1995 Rowan ..... A47B 13/081 108/65
5,568,775 A * 10/1996 Rizzi ..... A47B 87/002 108/68
5,676,068 A * 10/1997 Kallander ..... A47B 13/10 108/66
10,045,611 B1 * 8/2018 Siebert ..... A47B 87/002
2005/0247241 A1 * 11/2005 Sherman ..... A47B 13/088 108/64
2007/0062421 A1 * 3/2007 Sherman ..... A47B 13/088 108/64

FOREIGN PATENT DOCUMENTS

DE 9205984 U1 * 8/1992
DE 29719679 U1 * 3/1998
DE 10114614 A1 * 10/2002 ..... B27M 3/0026
SU 1545246 A1 * 2/1990
WO WO-2011111904 A1 * 9/2011 ..... A47B 87/002

* cited by examiner

*Primary Examiner* — Janet M Wilkens
(74) *Attorney, Agent, or Firm* — Klarquist Sparkman, LLP

(57) ABSTRACT

A table top can include a first table leaf and a second table leaf configured to define a half-lap joint with the first table leaf. The first table leaf and the second table leaf can be configured to form a planar top surface of the table top when coupled to form the half-lap joint. Each one of the first table leaf and the second table leaf can include an upper lobe, a lower lobe, and a pin rotatably connecting the upper lobe and the lower lobe.

19 Claims, 6 Drawing Sheets

FURNITURE TOP STRUCTURE

FIELD

The present application generally relates to furniture. More particularly, the present application relates to a top surface for knockdown furniture.

BACKGROUND

Furniture tops can comprise a plurality of shapes and sizes. However, tops are typically composed of a single, rigid unit with fixed dimensions. Expandable tops exist but utilize heavy mechanisms with a limited ability to increase usable surface area. Such tops are difficult to handle, ship, and move. Thus, there exists a need for a knockdown top that can have an unlimited size and can change in shape according to radial or other geometric topology.

SUMMARY

The present application discloses a knockdown top in accordance with certain examples of the invention that can solve one or more deficiencies in the prior art. In particular, the top can comprise a plurality of joined modular units configured to create a rigid, functional surface. Furthermore, the top can be reconfigured to expand or decrease in usable surface area, and to change in shape by the addition or removal of one or more modular units.

A table top can include a first table leaf and a second table leaf.

In some examples, the second table leaf can be configured to define a half-lap joint with the first table leaf.

In some examples, the first table leaf and the second table leaf can be configured to form a planar top surface of the table top when coupled to form the half-lap joint.

In some examples, each one of the first table leaf and the second table leaf can include an upper lobe and a lower lobe.

In some examples, each one of the first table leaf and the second table leaf can include a pin rotatably connecting the upper lobe and the lower lobe.

In some examples, each upper lobe and each lower lobe can include a crescent-shaped structure defining a concave surface, a convex surface, an upper surface, and a lower surface.

In some examples, a radius of curvature of the concave surface and a radius of curvature of the convex surface can be equal.

In some examples, the concave surface of the upper lobe of the first table leaf can be configured to be fayed to the convex surface of the upper lobe of the second table leaf to form an upper shoulder portion of the half-lap joint.

In some examples, the convex surface of the lower lobe of the first table leaf can be configured to be fayed to the concave surface of the lower lobe of the second table leaf to form a lower shoulder portion of the half-lap joint.

In some examples, the lower surface of the upper lobe of the first table leaf can be configured to be fayed to the upper surface of the lower lobe of the second table leaf to form a cheek portion of the half-lap joint.

A method can include mating a convex surface of a top lobe of a first epicyclic unit with a concave surface of a top lobe of a second epicyclic unit.

In some examples, the method can further include mating a concave surface of a bottom lobe of the first epicyclic unit with a convex surface of a bottom lobe of the second epicyclic unit.

In some examples, the top lobe and the bottom lobe of the first epicyclic unit can be pivotably connected.

In some examples, the top lobe and the bottom lobe of the second epicyclic unit can be pivotably connected.

In some examples, the method can be performed without tooling.

In a representative example, a top can comprise a plurality of identical modular units, each configured to define an upper lobe and a lower lobe. Each lobe can further comprise a circular disk such that a spandrel or semicircular cutout defines an inner, concave radius equal to the outer, convex radius of each lobe. Each module can further comprise a central pivot or pinion, defining a variable epicyclic rotation between each upper and lower lobe. As such, any two modules can be connected or fayed together along an imbricated or tessellated joint. Each joint can be further defined as a top portion having a convex lobe and a concave lobe aligned with a bottom portion having a complementary concave lobe and convex lobe such that the top and bottom portions combine to form a reversed spiral or spica to form a plane rigid surface. As configured, each module can have a single top and bottom tongue, as well as a single top and bottom spandrel or cutout.

In a representative example, a top can comprise a first modular unit and a second modular unit configured to define a first joint between the upper convex lobe of the first unit and the upper concave lobe of the second unit, and with the lower concave lobe of the first unit and the lower convex lobe of the second unit. The top can further comprise a third modular unit configured to define a second tessellated joint with the concave upper lobe of the first unit and the upper convex lobe of the third unit, and with a third joint connecting the lower convex lobe of the first unit and the lower concave lobe of the third unit. Simple fasteners can be employed to stabilize the joints as required. Such a top is configured into a plane surface conforming to radial topology, and particularly to a surface with triangular topology. A central, triangular oculus or aperture can result based on the juxtaposition of the cutout on each lobe of each module.

In a representative example, a top can comprise a first module, a second module configured to slidably connect along a first fayed, sculpted lap-joint to the first module, and a third module configured to slidably connect at a second fayed lap-joint to the first module, and to slidably connect to a third fayed lap-joint to the second module.

In a representative example, a method for assembling a top can comprise mating a plurality of tessellated modular units to form a plane surface.

In a representative example, a method for assembling a top can comprise mating a plurality of tessellated modular units to form a closed structure of variable size, shape, and function. Permutations can follow radial geometry, bilateral geometry, or be organic in form.

In a representative example, a method of increasing or decreasing the surface area and altering the radial topology of a top by means of adding or removing tessellated modular units configured to rotate axially enabling modification between a plurality of modular units such that the top can be altered in size and topology.

In a representative example, a table top can include a first table leaf and a second table leaf configured to define a half-lap joint with the first table leaf. The first table leaf and the second table leaf can be configured to form a planar top surface of the table top when coupled to form the half-lap joint. Each one of the first table leaf and the second table leaf can include an upper lobe, a lower lobe, and a pin rotatably connecting the upper lobe and the lower lobe.

In a representative example, a top can include a plurality of leaves configured to form a closed loop structure. Each leaf of the plurality of leaves can be configured to connect to a first adjacent leaf to form a first imbricated joint and connect to a second adjacent leaf to form a second imbricated joint.

In a representative example, a method can include: mating a convex surface of a top lobe of a first epicyclic unit with a concave surface of a top lobe of a second epicyclic unit, and mating a concave surface of a bottom lobe of the first epicyclic unit with a convex surface of a bottom lobe of the second epicyclic unit, wherein the top lobe and the bottom lobe of the first epicyclic unit can be pivotably connected. The top lobe and the bottom lobe of the second epicyclic unit can be pivotably connected.

The foregoing and other objects, features, and advantages of the invention will become more apparent from the following detailed description, which proceeds with reference to the accompanying figures.

DETAILED DESCRIPTION

General Considerations

Figure 1:
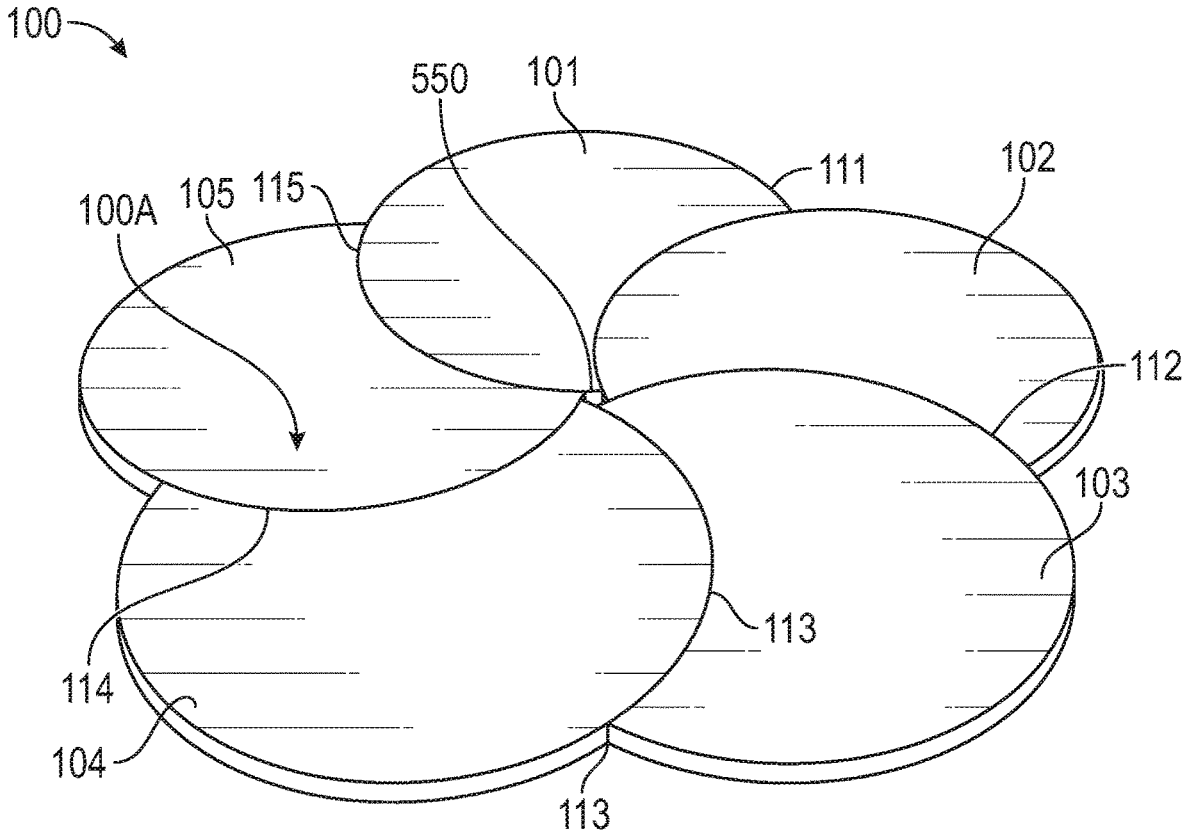
FIG. 1 is a perspective top view of a furniture top having a surface configured to follow radial topology and comprising five modules, according to one example.

For purposes of this description, certain aspects, advantages, and novel features of the embodiments of this disclosure are described herein. The disclosed methods, apparatus, and systems should not be construed as being limiting in any way. Instead, the present disclosure is directed toward all novel and nonobvious features and aspects of the various disclosed embodiments, alone and in various combinations and sub-combinations with one another. The methods, apparatus, and systems are not limited to any specific aspect or feature or combination thereof, nor do the disclosed embodiments require that any one or more specific advantages be present or problems be solved. The scope of this disclosure includes any features disclosed herein combined with any other features disclosed herein, unless physically impossible.

Although the operation of some of the disclosed examples are described in a particular, sequential order for convenient presentation, it should be understood that his manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods can be used in conjunction with other methods. Additionally, the description sometimes uses terms like "provide" or "achieve" to describe the disclosed methods. These terms are high level abstractions of the accrual operations that are performed. The actual operations that correspond to these terms may vary depending on the particular implementation and are readily discernible to one of ordinary skill in the art.

As used in the application and in the claims, the singular forms "a," "an," and "the" include the plural forms unless the context clearly dictates otherwise. Additionally, the term "includes" means "comprises." Further, the terms "coupled" and "associated" generally mean electrically, electromagnetically, and/or physically (e.g., mechanically or chemically) coupled or linked and does not exclude the presence of intermediate elements between the coupled or associated items absent specific contrary language.

In the description, certain terms may be used such as "forward," "front," "rear," "up," "down," "upper," "lower," "horizontal," "vertical," "left," "right," "longitudinal," "lateral," and the like. These terms are used, where applicable, to provide some clarity of description when dealing with relative relationships. However, these terms are not intended to imply absolute relationships, positions, and/or orientations. For example, with respect to an object, an "upper" surface can become a "lower" surface by turning the object over. Nevertheless, it is still the same object.

As used in this application and in the claims, the term "topology" refers to a horizontal cross-section of a top or other structure. For example, a top with "triangular topology" can refer to a structure with a horizontal cross section shaped like a triangle. For example, a top with a "radial topology" can refer to a structure with a radially symmetric horizontal cross section.

As used in this application and in the claims, the term "epicyclic unit" refers to two components (e.g., lobes) mounted together to form a modular unit, with the two components being rotatable, relative to each other, about a single pivot.

As used in this application and in the claims, the term "planar top surface" refers to one or more surfaces that individually and/or collectively define a substantially flat surface.

As used in this application and in the claims, the term "fayed" refers to a joint where all surfaces are tightly fit together.

As used in this application and in the claims, the term "tessellated" refers to a surface having a pattern of repeated shapes that fit together tightly without gaps and having a uniform thickness.

EXAMPLES OF THE DISCLOSED TECHNOLOGY

FIG. 1 is a perspective view of a top 100 (which is also referred to as a "furniture top" and/or a "table top") having a radial topology, according to one example. The top 100 (and/or any top or structure described herein) can be a portion of a piece of furniture configured to form a flat surface. For example, the top 100 (and/or any top or structure described herein) can be coupled to a base portion (e.g., one or more legs) to form a table. However, it should be understood that the top 100 can be used to form any piece of furniture (for example, a counter, a shelf, a desk, a stool) or furniture accessory (for example, a picture frame, a place mat, a coaster, a mousepad, etc.) that defines a flat surface.

As shown, the top 100 can comprise rigid modules 101, 102, 103, 104, and 105 (which are also referred to herein as "modular units," "table top portions," "epicyclic units," "leaves," "furniture leaves," and/or "table leaves"). However, as discussed below with respect to other examples, the top 100 can include any number of modules. Each module 101, 102, 103, 104, and 105 can be equal in size, shape, and thickness. Modules 101, 102, 103, 104, and 105 can be connected by interlocked knockdown joints 111, 112, 113, 114, and 115 (which are also referred to herein as "joints," "imbricated joints," "tessellated joints," and/or "half-lap joints"). Although specific reference is made to half-lap joints throughout the present disclosure, any suitable joint can be used to connect the modules. Each module 101, 102, 103, 104, and 105 can be slidably joined or connected to two adjacent modules, e.g., module 101 can connect with module 102 at half-lap joint 111, and with module 105 at half-lap joint 115. Each module 101, 102, 103, 104, and 105 can be connected to define a planar top surface 100A of the top 100. A central void or oculus 550 can be present in this example, wherein the top 100 conforms to a pentagonal topology by the alignment of the five modules 101, 102, 103, 104, and 105.

Figure 2:
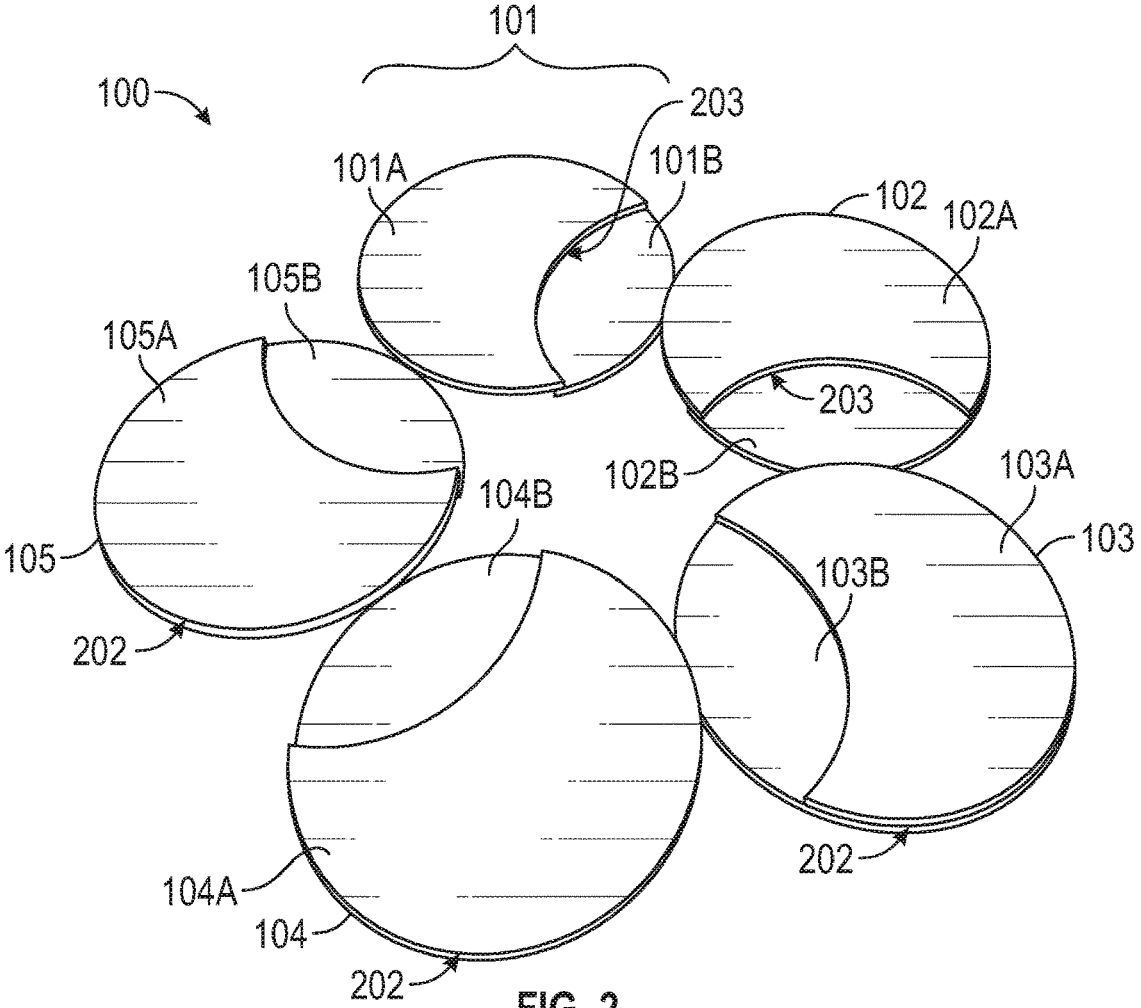
FIG. 2 is an exploded perspective top view of the furniture top of FIG. 1.

FIG. 2 is an exploded perspective view of the top 100 of FIG. 1 showing modules 101, 102, 103, 104, and 105 separated from each other. Each module 101, 102, 103, 104, and 105 can comprise a top tongue portion 101A, 102A, 103A, 104A, and 105A (which is also referred to herein as an "upper lobe"), respectively, and a bottom tongue portion 101B, 102B, 103B, 104B, and 105B (which is also referred to herein as a "bottom lobe"), respectively. Each lobe can include a convex surface 202 (which is also referred to herein as a "convex portion") that can slidably connect to or mate with a corresponding concave surface 203 (which is also referred to herein as a "concave portion") of an adjacent lobe along plane lines. Each top and bottom lobe can also comprise a centered pivot 200 (FIG. 4) to pivotably or rotatably connect and align each module into an epicyclic unit that can define an axial rotation between lobes in a turret-like fashion. As such, each module 101, 102, 103, 104, and 105 can be slidably connected to two adjacent units to form a rigid, tessellated structure (i.e., the top 100). Mechanical and/or magnetic fasteners can be employed to add stability to each joined top and bottom lobe on each module as appropriate.

Figure 4:
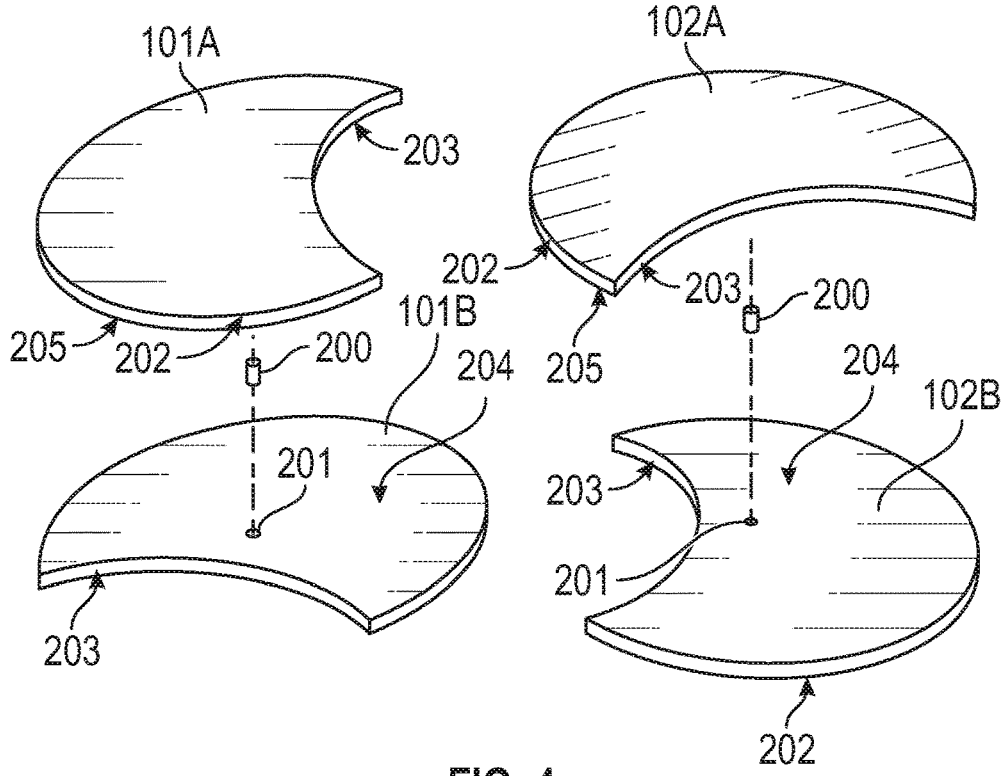
FIG. 4 is an exploded perspective view of the two modules of FIG. 3, showing each top and bottom lobe, with holes drilled for a central alignment pivot.

FIG. 4 is an exploded perspective top view of two modules 101 and 102 showing upper lobes 101A and 102A and lower lobes 101B and 102B. Each module 101 and 102 includes two lobes. For example, module 101 includes the upper lobe 101A and the lower lobe 101B. Similarly, module 102 includes the upper lobe 102A and the lower lobe 102B. Each lobe 101A, 101B, 102A, and 102B can comprise an identical crescent-shaped or lune-shaped structure of appropriate material, size, thickness, and radius or diameter. Each lobe 101A, 101B, 102A, and 102B can include a convex surface 202 and a concave surface 203. As shown, the convex surface 202 and the concave surface 203 have the same radius of curvature. Each lobe 101A, 101B, 102A, and 102B can have an upper surface 204 and a lower surface 205. In some examples, the upper surface 204 and the lower surface 205 of each lobe 101A, 101B, 102A, and 102B can be flat or planar. A void or hole 201 can be drilled at the center of the arc (which is also referred to herein as a "convex arc") defining the convex surface 202, and a pin or pivot 200 (which is also referred to herein as an "indexing pin") can be employed to allow for epicyclic rotation between each upper and lower lobe.

Figure 3:
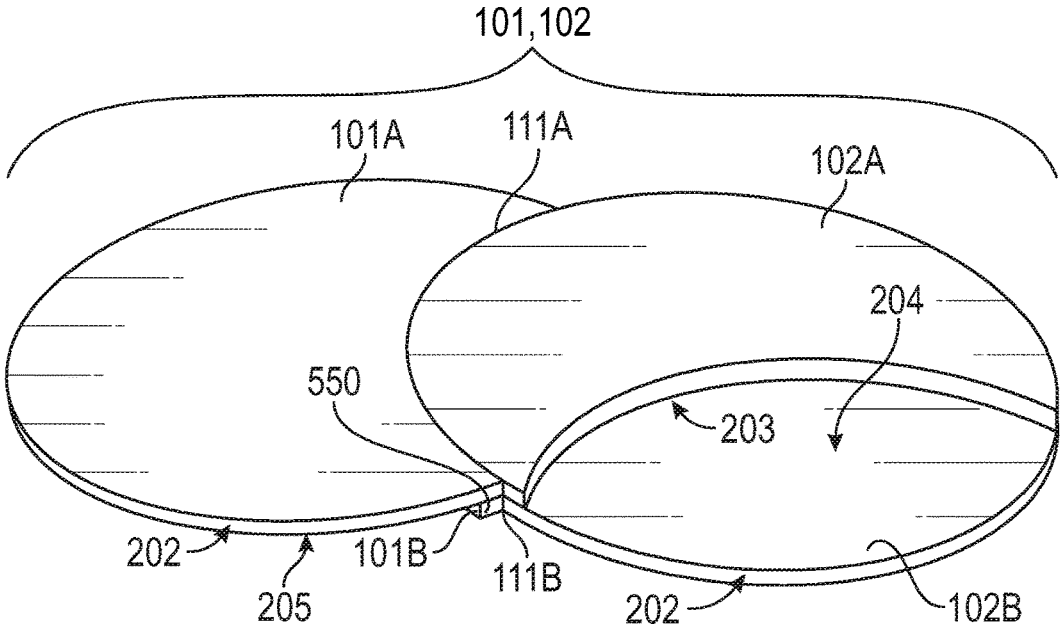
FIG. 3 is a perspective top view of two modules of FIG. 1 configured in a tessellated joint.

As shown in FIG. 3, three surfaces of the module 101 can contact three corresponding surfaces of the adjacent module 102 to form the half-lap joint connecting modules 101 and 102. The concave surface 203 of the upper lobe 101A can be tightly fit or fayed to the convex surface 202 of the upper lobe 102A to form a first shoulder portion 111A (which is also referred to herein as an "upper shoulder portion" and/or a "top shoulder portion") of the half-lap joint 111. The concave surface 203 of the lower lobe 102B can be fayed to the convex surface 202 of the lower lobe 101B to form a second shoulder portion 111B (which is also referred to herein as a "lower shoulder portion" and/or a "bottom shoulder portion") of the half-lap joint 111. The upper surface 204 of the lower lobe 102B can be fayed to the lower surface 205 of the upper lobe 101A to form a cheek portion (which is also referred to herein as a "middle portion" and/or an "intermediate portion") of the half-lap joint 111. In this example, no permanent bonding between modules is employed, beneficially allowing for moving, assembly, and disassembly as desired with minimal, if any, tooling. An oculus 550 can be formed according to the juxtaposition between the size of each concave and convex surface on each lobe. Any number of additional modules can be then added to form a closed, tessellated loop of modules, which beneficially provides for a modular table surface.

Figure 5:
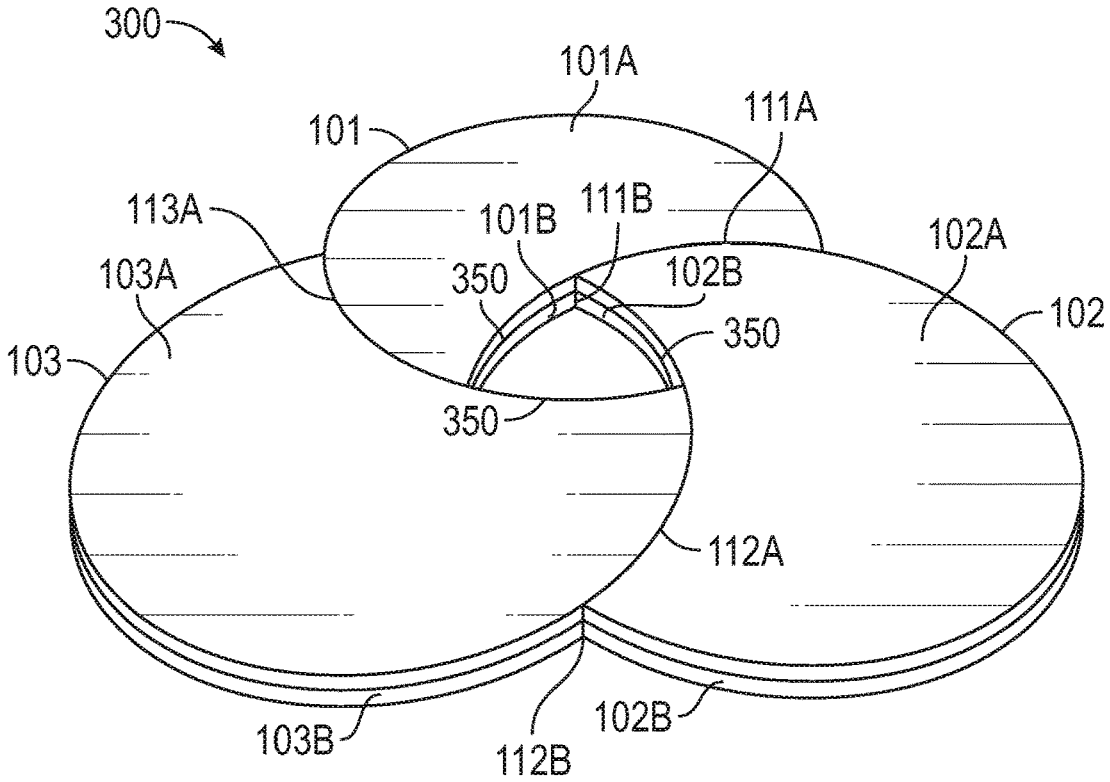
FIG. 5 is a perspective top view of a furniture top comprising three modules, according to one example.

FIG. 5 is a perspective top view of a furniture top 300 comprising three modules 101, 102, and 103, according to one example. The three modules 101, 102, and 103 can be aligned and configured such that the top 300 has a triangular topology. Each top lobe 101A, 102A, and 103A can be fayed together at the upper shoulder portions 111A, 112A, and 113A of half-lap joints 111, 112, and 113, respectively. Each bottom lobe 101B, 102B, and 103B can be fayed together in a reversed manner, for example, at bottom shoulder portions 111B and 112B of joints 111 and 112, to form a reverse spiral or spica between all top and bottom lobes forming the structure. A triangular oculus 350 is a consequence of the radial geometry used in this example and is defined by a portion of the cutout on each lobe.

Figure 6:
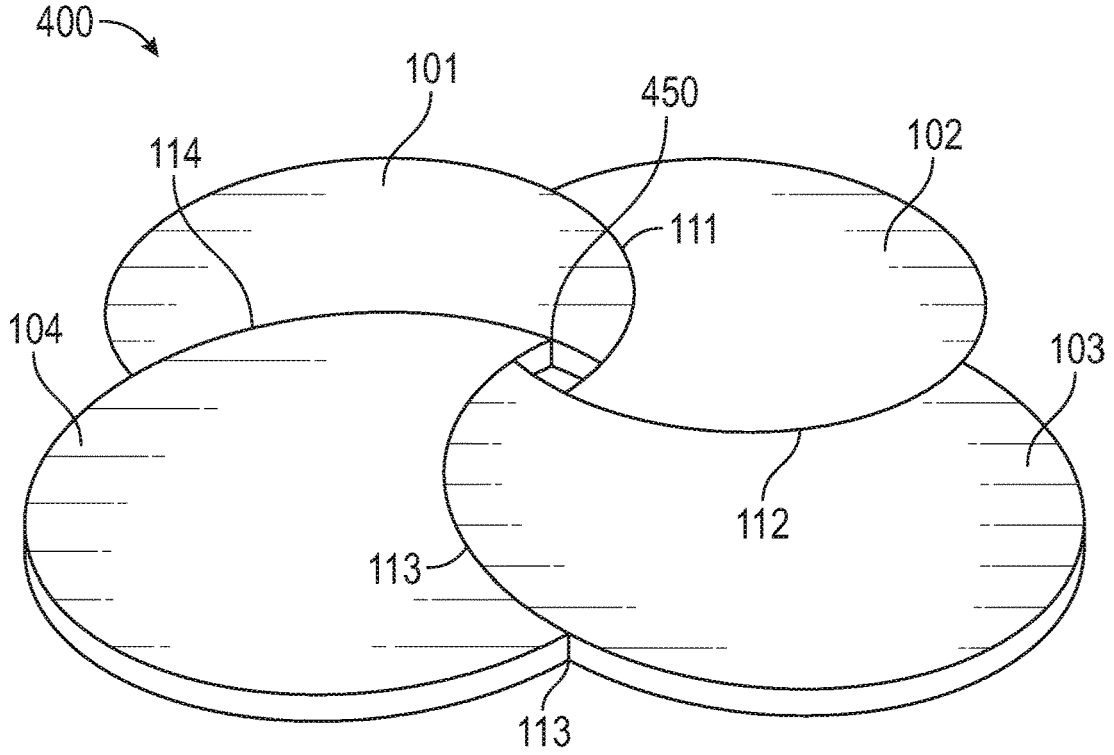
FIG. 6 is a perspective top view of a furniture top comprising four modules, according to one example.

FIG. 6 is a perspective top view of a furniture top 400 comprising four modules 101, 102, 103, and 104 configured to define a top with quadrangular radial topology, according to an example. Module 101 can be slidably connected to module 104 at tessellated joint 114, and can be slidably connected to module 102 at tessellated joint 111. Module 103 can then be slidably connected to module 102 at tessellated joint 112, and can be slidably connected to module 104 at tessellated joint 113. In this example, an oculus 450 having quadrangular topology is defined by a segment of each cutout edge of each module.

Figure 7:
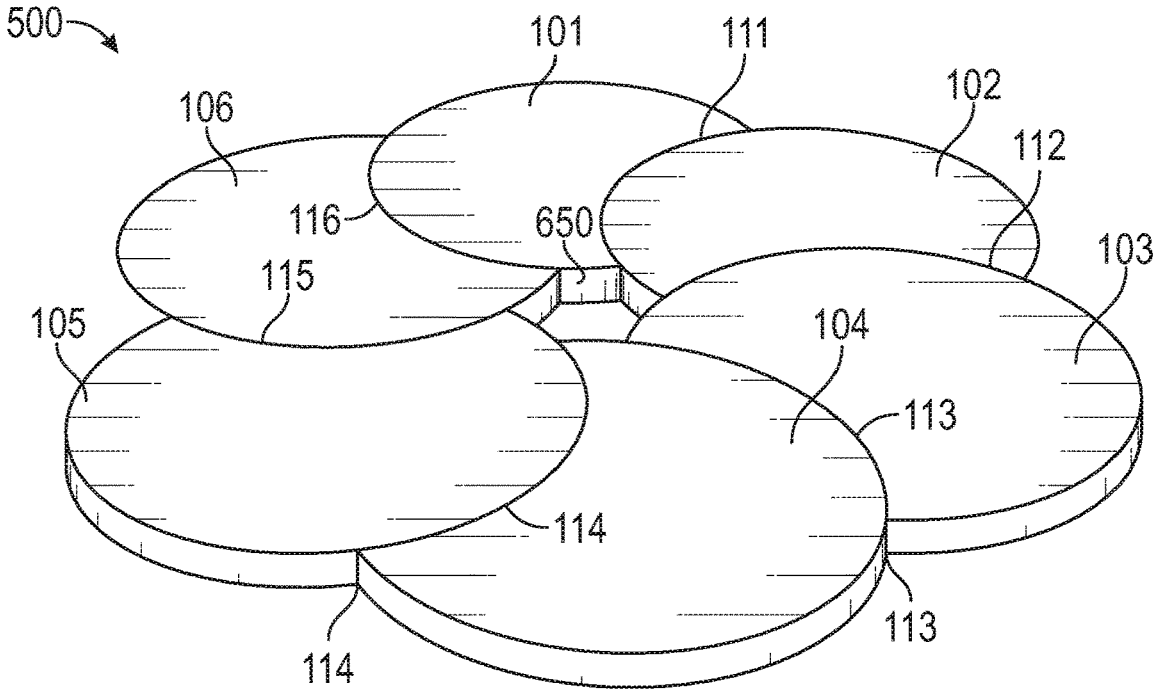
FIG. 7 is a perspective top view of a furniture top comprising six modules, according to one example.

FIG. 7 is a perspective top view of a furniture top 500 comprising six modules 101, 102, 103, 104, 105, and 106 configured to form a top with hexagonal radial topology. Module 101 can be fayed or tessellated to module 106, and to module 102, at joints 116 and 111, respectively. Module 103 can be fayed to modules 102 and 104 at joints 112 and 113, respectively. Module 105 can then be fayed or imbricated to modules 104 and 106 at joints 114 and 115, respectively. In this example, an oculus 650 having hexagonal topology is resultant, and is formed by a convergence of a segment of each convex lobe at the center of the structure.

Figure 8:
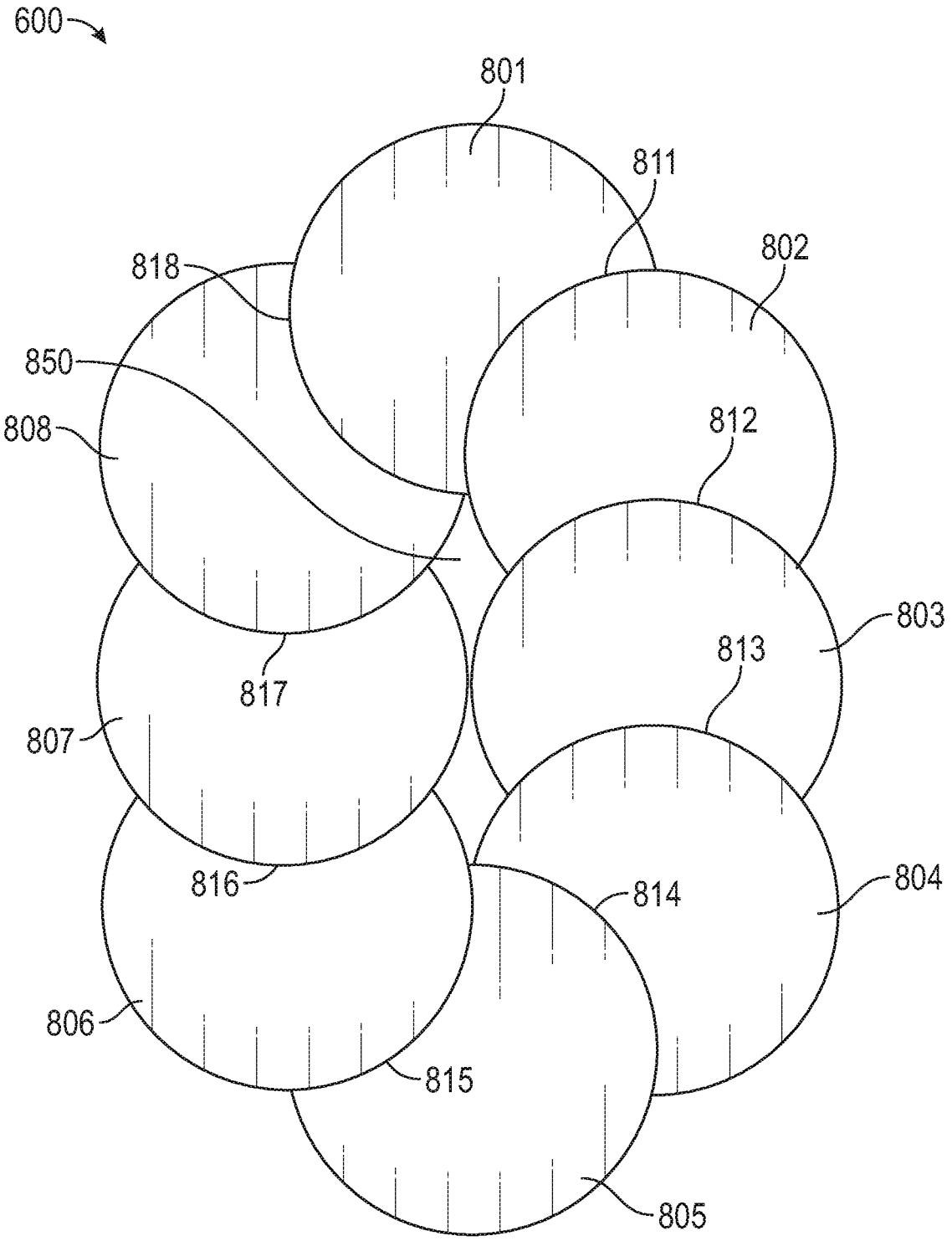
FIG. 8 is a perspective top section view of a furniture top comprising eight modules configured to form a closed loop structure, according to one example.

FIG. 8 is a perspective top section view of a furniture top 600 composed of eight modules 801, 802, 803, 804, 805, 806, 807, and 808 configured to define a top conforming to an oval or elliptical topology. In this example, different modules 801, 802, 803, 804, 805, 806, 807, and 808 can have different relative angles between the top and bottom lobes, such that the top 600 is radially asymmetric. Module 801 can be fayed to module 802 at joint 811, and fayed to module 808 at joint 818. Module 805 can be fayed to module 806 at joint 815, and to module 804 at joint 814. Module 803 can be fayed to module 802 at joint 812, and to module 804 at joint 813. Module 807 can be fayed to module 806 at joint 816, and with module 808 at joint 817. As shown, the top conforms to an oval or elliptical topology. An oculus 850 is defined by the juxtaposition of each module in the structure.

Figure 9:
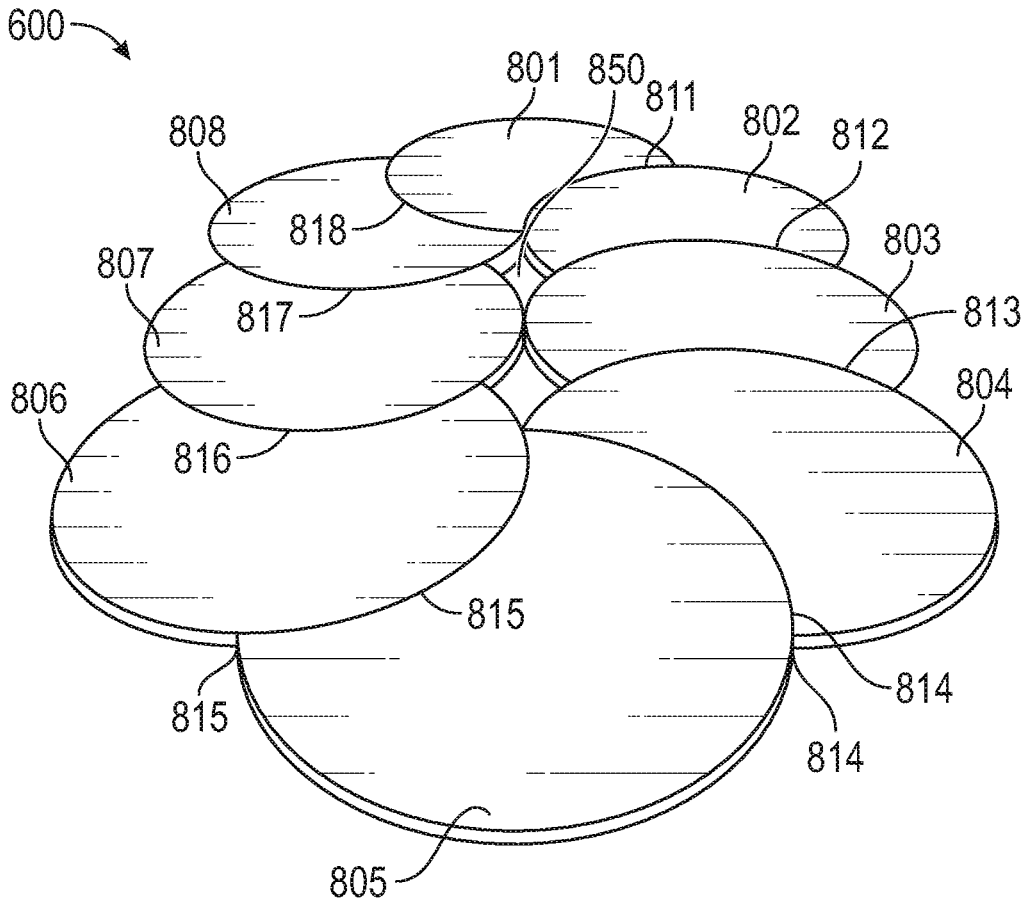
FIG. 9 is a perspective top front section view of the furniture top of FIG. 8 conforming to oval or bilateral symmetry.

FIG. 9 is a perspective top front view of the top 600 of FIG. 8 showing modular units 801, 802, 803, 804, 805, 806, 807, and 808 configured to define a top with oval or elliptical topology. Module 803 can be slidably connected to module 802 at joint 812, and with module 804 at joint 813. Module 807 can be slidably connected to module 806 at joint 816, and with module 808 at joint 817. Module 801 can be slidably connected with module 802 at joint 811, and can be slidably connected to module 808 at joint 818. Module 805 can then be slidably connected to modules 804 and 806 at joints 814 and 815 respectively, forming a closed plane structure. In this example, the oculus 850 can be expanded by employing slight modifications to the relative angles between cutouts on some or all of the modules in use, thereby changing the topology of the structure, i.e., the modules can be reconfigured to define a top exhibiting octagonal radial topology.

Operation

In operation, one aligns each module axially conforming to the radial geometry required to form a closed loop of modules wherein each module is connected to two adjacent modules. Each individual module can be indexed to its appropriate radial juxtaposition by using visual, magnetic, and/or mechanical alignment mechanisms. For example, referring back to the example illustrated in FIG. 1, a top 100 with pentagonal topology can be constructed from five individual modules indexed such that the correlation between each top and bottom lobe is configured to achieve a slidable, tessellated connection defined according to radial pentagonal geometry. A first module 101 can be placed top face down onto a stable horizontal surface. A second module 102 can then be aligned top face down to slidably connect to module 101 along the fayed and sculpted joint 111. Magnetic or mechanical fasteners can then be used to add stability to the joint 111 by connecting the bottom lobe 101B of the first module 101 to the top lobe 102A of the second module 102. Modules can be further added sequentially, slidably connecting module 103 to module 102, module 104 to module 103, and module 105 to modules 104 and 101, forming a rigid, closed ring-like structure conforming to pentagonal topology. The joined top can then be turned over to expose the top surface and can then be attached to a suitable supporting base (for example, one or more legs) to form a table or other piece of furniture.

The top can be changed in size and shape by the addition of one or more modular units. As an example, a pentagonal top can be disassembled by reversing the assembly instructions, then re-indexing the necessary modules axially into a hexagonal or an octagonal configuration for reassembly into a top surface with a larger surface area. In this way, the top can be beneficially enlarged or reduced in a modular fashion with a minimal use of tooling.

The top can also be decreased in size and shape by removing one or more modular units. As an example, a pentagonal top can be disassembled, re-indexed, and reassembled into a structure conforming to quadrille or triangular topology as needed.

Modules can be further aligned to form an unlimited number of surface shapes and sizes. As an example, a top can be defined to form an organic shape provided that each module is configured to join two adjacent modules. In another example, an oculus could be configured to define an area enabling a surface to extend around a tree or fountain.

In another example, a top conforming to hexagonal topology can be disassembled, re-indexed, and reconfigured into two separate tops, each conforming to triangular topology. Configurations and reconfigurations are limited by only the number of available modular units Modules are sizable, allowing for changes in purpose and use by alteration of physical dimensions, materials, fastener type, or geometric topology while maintaining epicyclic symmetry. Tops can be configured into modular groups along horizontal planes as a means to provide a rigid surface larger than the capacity of a single table structure.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

EXAMPLES

In view of the above-described implementations of the disclosed subject matter, this application discloses the additional examples enumerated below. It should be noted that one feature of an example in isolation or more than one feature of the example taken in combination and, optionally, in combination with one or more features of one or more further examples are further examples also falling within the disclosure of this application.

Example 1. A table top can include a first table leaf and a second table leaf configured to define a half-lap joint with the first table leaf. The first table leaf and the second table leaf can be configured to form a planar top surface of the table top when coupled to form the half-lap joint. Each one of the first table leaf and the second table leaf can include an upper lobe, a lower lobe, and a pin rotatably connecting the upper lobe and the lower lobe.

Example 2. The table top of any example herein, particularly Example 1, wherein the table top can have a radial topology.

Example 3. The table top of any example herein, particularly any one of Examples 1-2, wherein each upper lobe and each lower lobe can include a crescent-shaped structure defining a concave surface, a convex surface, an upper surface, and a lower surface.

Example 4. The table top of any example herein, particularly Example 3, wherein a radius of curvature of the concave surface and a radius of curvature of the convex surface can be equal.

Example 5. The table top of any example herein, particularly any one of Examples 3-4, wherein the concave surface of the upper lobe of the first table leaf can be configured to be fayed to the convex surface of the upper lobe of the second table leaf to form an upper shoulder portion of the half-lap joint.

Example 6. The table top of any example herein, particularly any one of Examples 3-5, wherein the convex surface of the lower lobe of the first table leaf can be configured to be fayed to the concave surface of the lower lobe of the second table leaf to form a lower shoulder portion of the half-lap joint.

Example 7. The table top of any example herein, particularly any one of Examples 3-6, wherein the lower surface of the upper lobe of the first table leaf can be configured to be fayed to the upper surface of the lower lobe of the second table leaf to form a cheek portion of the half-lap joint.

Example 8. The table top of any example herein, particularly Example 7, wherein the table top can further include a fastener configured to secure the lower surface of the upper lobe of the first table leaf to the upper surface of the lower lobe of the second table leaf.

Example 9. The table top of any example herein, particularly any one of Examples 1-7, wherein each one of the first table leaf and the second table leaf can include an alignment mechanism configured to index the upper lobe relative to the lower lobe of the respective table leaf.

Example 10. A top can include a plurality of leaves configured to form a closed loop structure. Each leaf of the plurality of leaves can be configured to connect to a first adjacent leaf to form a first imbricated joint and connect to a second adjacent leaf to form a second imbricated joint.

Example 11. The top of any example herein, particularly Example 10, wherein the plurality of leaves can be a modular plurality of leaves.

Example 12. The top of any example herein, particularly any one of Examples 10-11, wherein each leaf can be configured to slidingly connect to the first adjacent leaf and slidingly connect to the second adjacent leaf.

Example 13. The top of any example herein, particularly any one of Examples 10-12, wherein the closed loop structure can be configured to define a central oculus.

Example 14. The top of any example herein, particularly any one of Examples 10-12, wherein each leaf of the plurality of leaves can include a top tongue portion pivotably coupled to a bottom tongue portion.

Example 15. The top of claim 14, wherein the top tongue portion can define a first convex arc, the bottom tongue portion can define a second convex arc, and a pivot can extend from a center of the first convex arc to a center of the second convex arc.

Example 16. A method can include: mating a convex surface of a top lobe of a first epicyclic unit with a concave surface of a top lobe of a second epicyclic unit, and mating a concave surface of a bottom lobe of the first epicyclic unit with a convex surface of a bottom lobe of the second epicyclic unit. The top lobe and the bottom lobe of the first epicyclic unit can be pivotably connected. The top lobe and the bottom lobe of the second epicyclic unit can be pivotably connected.

Example 17. The method of any example herein, particularly Example 16, can further include, prior to mating the concave surface of the bottom lobe of the first epicyclic unit with the convex surface of the bottom lobe of the second epicyclic unit, indexing the top lobe of the first epicyclic unit relative to the bottom lobe of the first epicyclic unit.

Example 18. The method of any example herein, particularly any one of Examples 16-17, can further include, after mating the concave surface of the bottom lobe of the first epicyclic unit with the convex surface of the bottom lobe of the second epicyclic unit, coupling the first epicyclic unit and the second epicyclic unit to a base comprising one or more legs to form a table.

Example 19. The method of any example herein, particularly any one of Examples 16-18, can further include, after mating the concave surface of the bottom lobe of the first epicyclic unit with the convex surface of the bottom lobe of the second epicyclic unit: separating the first epicyclic unit and the second epicyclic unit; mating the convex surface of the top lobe of the first epicyclic unit with a concave surface of a top lobe of a third epicyclic unit; mating the concave surface of the bottom lobe of the first epicyclic unit with a convex surface of a bottom lobe of the third epicyclic unit; mating the concave surface of the top lobe of the second epicyclic unit with a convex surface of a top lobe of the third epicyclic unit; and mating the convex surface of the bottom lobe of the second epicyclic unit with a concave surface of a bottom lobe of the third epicyclic unit.

Example 20. The method of any example herein, particularly any one of Examples 16-19, wherein the method can be performed without tooling.

The features described herein with regard to any example can be combined with other features described in any one or more of the other examples, unless otherwise stated. For example, any one or more of the features of one furniture top can be combined with any one or more features of another furniture top. As another example, any one or more features of one table leaf can be combined with any one or more features of another table leaf.

In view of the many possible ways in which the principles of the disclosure may be applied, it should be recognized that the illustrated configurations depict examples of the disclosed technology and should not be taken as limiting the scope of the disclosure nor the claims. Rather, the scope of the claimed subject matter is defined by the following claims and their equivalents.

I claim:

1. A table top comprising:

a first table leaf;

a second table leaf; and a third table leaf, wherein each one of the first table leaf, the second table leaf, and the third table leaf comprises an upper lobe, a lower lobe, and a pin rotatably connecting the upper lobe and the lower lobe, wherein, in a first configuration, the first table leaf and the second table leaf are configured to form a planar top surface of the table top when coupled, wherein, in a second configuration, the first table leaf, the second table leaf, and the third table leaf are configured to form a planar top surface of the table top when coupled, and wherein relative rotation about the pin between the upper lobe and lower lobe provides for a first orientation between the upper lobe and lower lobe that defines the first configuration and a second orientation between the upper lobe and lower lobe that defines the second configuration.

2. The table top of claim 1, wherein the table top has a radial topology.

3. The table top of claim 1, wherein each upper lobe and each lower lobe comprises a crescent-shaped structure defining a concave surface, a convex surface, an upper surface, and a lower surface.

4. The table top of claim 3, wherein a radius of curvature of the concave surface and a radius of curvature of the convex surface are equal.

5. The table top of claim 3, wherein the concave surface of the upper lobe of the first table leaf is configured to be fayed to the convex surface of the upper lobe of the second table leaf to form an upper shoulder portion of a half-lap joint.

6. The table top of claim 3, wherein the convex surface of the lower lobe of the first table leaf is configured to be fayed to the concave surface of the lower lobe of the second table leaf to form a lower shoulder portion of a half-lap joint.

7. The table top of claim 3, wherein the lower surface of the upper lobe of the first table leaf is configured to be fayed to the upper surface of the lower lobe of the second table leaf to form a cheek portion of a half-lap joint.

8. The table top of claim 7, wherein the lower surface of the upper lobe of the first table leaf is secured to the upper surface of the lower lobe of the second table leaf.

9. The table top of claim 1, where the pin is positioned at a diametric center of the leaf.

10. A top comprising:

a plurality of leaves configured to form a closed loop structure, wherein each leaf of the plurality of leaves comprises an upper lobe, a lower lobe, and a pin rotatably connecting the upper lobe and the lower lobe, and is configured to slidingly connect to a first adjacent leaf to form a first imbricated joint and to slidingly connect to a second adjacent leaf to form a second imbricated joint, wherein, in a first configuration, the plurality of leaves comprises a first number of leaves coupled to form a planar top surface, and wherein, in a second configuration, the plurality of leaves comprises a second, greater number of leaves coupled to form a planar top surface, and wherein relative rotation about the pin between the upper lobe and lower lobe of each leaf provides an orientation of the leaf that defines the first configuration and the second configuration.

11. The top of claim 10, wherein the plurality of leaves are a modular plurality of leaves.

12. The top of claim 10, wherein each leaf is configured to slidingly connect to the first adjacent leaf and slidingly connect to the second adjacent leaf.

13. The top of claim 10, wherein the closed loop structure is configured to define a central oculus.

14. The top of claim 10, wherein each leaf of the plurality of leaves includes a top tongue portion pivotably coupled to a bottom tongue portion.

15. The top of claim 14, wherein the top tongue portion defines a first convex arc, the bottom tongue portion defines a second convex arc, and a pivot extends from a center of the first convex arc to a center of the second convex arc.

16. The top of claim 10, where the pin is positioned at a diametric center of the leaf.

17. A method comprising:

mating a convex surface of a top lobe of a first epicyclic unit with a concave surface of a top lobe of a second epicyclic unit; and mating a concave surface of a bottom lobe of the first epicyclic unit with a convex surface of a bottom lobe of the second epicyclic unit, wherein the top lobe and the bottom lobe of the first epicyclic unit are pivotably connected, and wherein the top lobe and the bottom lobe of the second epicyclic unit are pivotably connected, and further comprising, prior to mating, rotating the top lobe relative to the bottom lobe of each epicyclic unit about a pin positioned at a diametric center of the respective unit, the pin rotatably connecting the top lobe and the bottom lobe, wherein, in a first configuration, the first epicyclic unit and the second epicyclic unit are oriented by rotation about the respective pins to define an orientation that forms a planar top surface when coupled, and wherein, in a second configuration, the first epicyclic unit, the second epicyclic unit, and a third epicyclic unit are oriented by rotation about the respective pins to define an orientation that forms a planar top surface when coupled.

18. The method of claim 17, further comprising, after mating the concave surface of the bottom lobe of the first epicyclic unit with the convex surface of the bottom lobe of the second epicyclic unit:

separating the first epicyclic unit and the second epicyclic unit;

mating the convex surface of the top lobe of the first epicyclic unit with a concave surface of a top lobe of a third epicyclic unit;

mating the concave surface of the bottom lobe of the first epicyclic unit with a convex surface of a bottom lobe of the third epicyclic unit;

mating the concave surface of the top lobe of the second epicyclic unit with a convex surface of a top lobe of the third epicyclic unit; and mating the convex surface of the bottom lobe of the second epicyclic unit with a concave surface of a bottom lobe of the third epicyclic unit.

19. The method of claim 17, wherein the method is performed without tooling.

* * * * *